United States Patent [19]

Negra et al.

[11] Patent Number: 4,677,295

[45] Date of Patent: Jun. 30, 1987

[54] PROCESS FOR DETERMINING MASS SPECTRUM BY TIME OF FLIGHT AND SPECTROMETER CARRYING OUT THIS PROCESS

[75] Inventors: Serge D. Negra, Chilly Mazarin; Yvon Le Beyec, Bures sur Yvette, both of France

[73] Assignee: Centre National de la Recherche Scientifique, Paris, France

[21] Appl. No.: 760,678

[22] Filed: Jul. 30, 1985

[30] Foreign Application Priority Data

Aug. 9, 1984 [FR] France ..... 84 12609

[51] Int. Cl.[4] ..... H01J 47/40

[52] U.S. Cl. ..... 250/287; 250/423 F

[58] Field of Search ..... 250/287, 423 F, 423 R

[56] References Cited

U.S. PATENT DOCUMENTS 3,868,507 2/1975 Panitz ..... 250/287

FOREIGN PATENT DOCUMENTS 1171641 6/1964 Fed. Rep. of Germany ... 250/423 F

OTHER PUBLICATIONS

Andrade et al., Nuclear Instruments and Methods, vol. 21, No. 2, 1974, pp. 359–363.

Nuclear Instruments and Methods, vol. 188, Sep. 1981, pp. 99–104, North-Holland Publishing Comp., Amsterdam, NL; E. Festa et al.: "A Multistop Time-to-Digital Converter" * p. 99; FIG. 1* .

International Journal of Mass Spectroscopy and Ion Physics, vol. 52, No. 2/3, Sep. 1983, pp. 223–240, Elsevier Science Publishers B.V., Amsterdam, NL; H. Danigel et al.: "A 252Cf Fission Fragment-Inducted Desorption Mass Spectrometer: Design, Operation and Performance", * p. 224, lignes 4–7; FIG. 5 * .

*Primary Examiner*—Craig E. Church

*Assistant Examiner*—Jack I. Berman

*Attorney, Agent, or Firm*—Roberts, Spiecens & Cohen

[57] ABSTRACT

A process for determining mass spectrum by time of flight, wherein a source comprising a solid surface is subjected to the action of an electric field between this surface and an electrode, this provoking the simultaneous emission of electrons and of negative ions released by spontaneous desorption; the electrons and negative ions are received successively by a detector to determine the mass spectrum as a function of the differences between the instants of reception of the electrons and the negative ions.

6 Claims, 3 Drawing Figures

COUNTS

VALINE
(Mass spectrum obtained with a process according to the invention)
300
200
100
0
H-1
16-
13-
17-
26-
25-
12-
24-
116-
1000
3000
5000
7000
9000
TIME (ns)

COUNTS

VALINE
(Mass spectrum obtained with a prior art process)
3000
1500
26-
116-
905
1305
1705
2105
2505
TIME (ns)

PROCESS FOR DETERMINING MASS SPECTRUM BY TIME OF FLIGHT AND SPECTROMETER CARRYING OUT THIS PROCESS

FIELD OF THE INVENTION

The present invention relates to the determination of mass spectrum by time of flight.

BACKGROUND

In a time-of-flight mass spectrometer, ions are extracted from a source containing a product to be analyzed and their mass is determined by measuring their time of flight up to a detection device.

The source of ions is for example constituted by a solid surface from which the ions are released by desorption. Several techniques are used to that end. For example, the solid surface may be bombarded with primary ions accelerated by cyclotron or be subjected to a high-energy radiation. It is also well known to employ a radioactive source $^{252}Cf$ which emits two fission fragments in opposite directions, one being directed towards the solid surface to release ions and the other towards a metal foil to eject electrons of which detection furnishes the time reference (starting signal).

SUMMARY OF THE INVENTION

It is an object of the present invention to provide a process for determining mass spectrum by time of flight under conditions much simpler than those prevailing with the processes known at the present time.

This object is attained by a process whereby, according to the invention, a source comprising a solid surface is subjected to the action of a constant electric field provoking the simultaneous emission, on the one hand, of electrons and, on the other hand, of negative ions released from said surface by spontaneous desorption, and the mass spectrum is determined from the differences in time of flight of the electrons and the negative ions between the source and a detection device.

The present invention is based on the observation that the application of a constant electric field unexpectedly provokes the emission, correlated in time, of electrons and negative ions. The reception of the electrons by the detection device then furnishes the time reference for measuring the time of flight of the negative ions arriving on this detection device. In addition to the simplicity of carrying it out, the process according to the invention presents the advantage of being non-destructive with respect to the source of ions.

The spontaneous desorption does not necessitate an electric field of very high intensity. By way of indication, a field of constant intensity of between 1 and 3 MV/m may suffice.

It is also an object of the present invention to provide a time-of-flight mass spectrometer for carrying out the process defined hereinbefore.

This object is attained by a spectrometer comprising: an enclosure adapted to be connected to a vacuum source, means for releasing by desorption ions from a source formed by a solid surface placed in the enclosure, a detection device comprising means for detecting ions issuing from the source, and a measuring device for determining the sought-for mass spectrum from quantities representative of the time of flight of the ions between the source and the detection device, in which spectrometer, according to the invention, means are provided for establishing a constant electric field between the solid surface and a grid-shaped electrode placed in front of this surface in order to provoke the simultaneous emission, on the one hand, of electrons and, on the other hand, of negative ions released from said surface by spontaneous desorption; and the measuring device comprises means for elaborating quantities representative of the intervals of time separating the reception of electrons and the reception of negative ions by the detection device.

BRIEF DESCRIPTION OF THE DRAWINGS

The invention will be more readily understood on reading the following description with reference to the accompanying drawings, in which.

DETAILED DESCRIPTION

Figure 1:
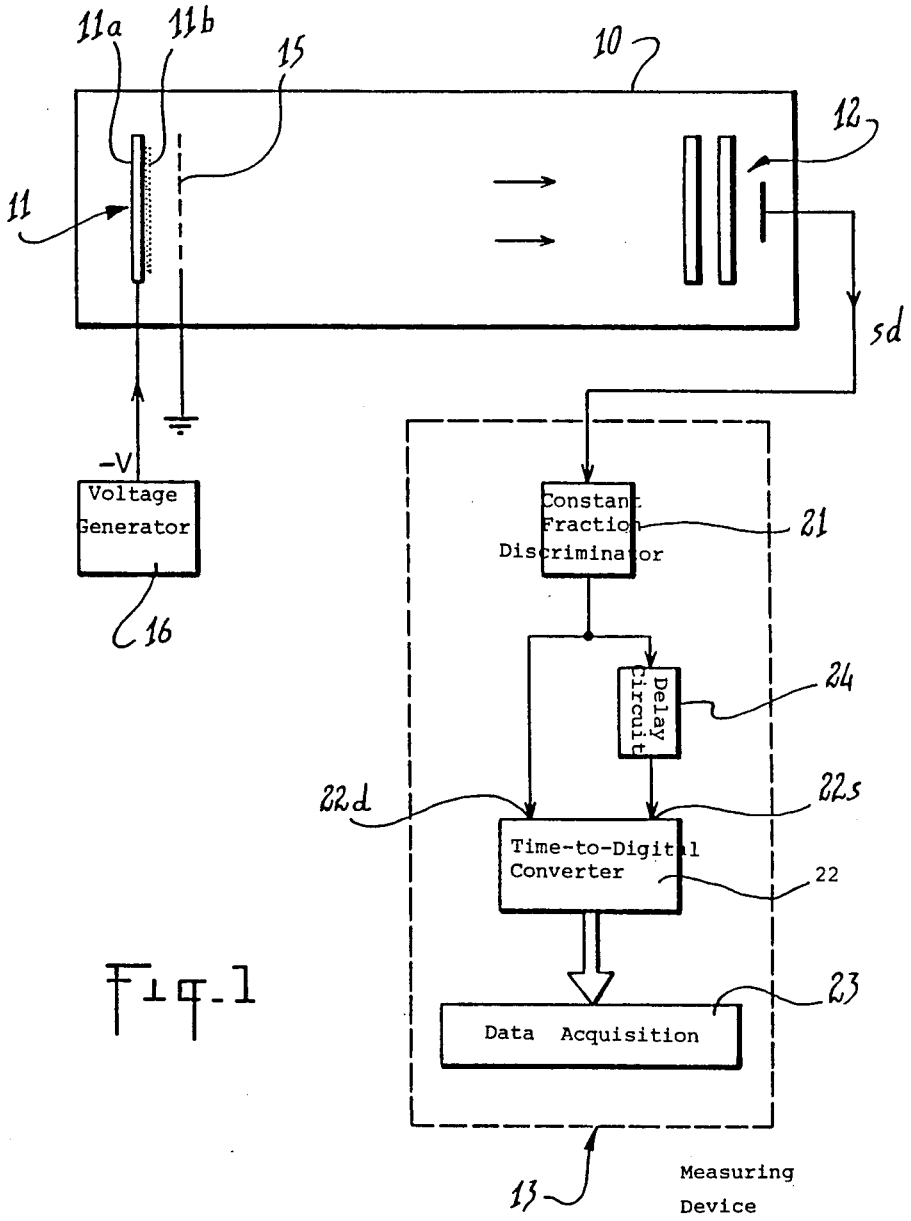
FIG. 1 is a very schematic view of an embodiment of a time-of-flight mass spectrometer according to the invention.

Referring now to the drawings, the spectrometer shown in FIG. 1 essentially comprises a tube 10 connected to a vacuum source (not shown) for establishing a high vacuum, for example $10^{-6}$ to $10^{-7}$ Torr inside the tube 10.

A source of ions 11 is disposed in the vicinity of a first end, or rear end, of the tube 10, inside the latter. In the example illustrated, the source 11 is constituted by a thin metal foil 11*a*, in the form of a flat disc, on the front face of which is deposited a thin uniform layer 11*b* of a compound to be analyzed in mass, particularly an organic compound. The foil 11*a* is for example an aluminium foil of thickness equal to 5 microns. The compound to be analyzed is deposited on the foil 11*a*, for example by electrostatic projection, the mass of compound deposited being for example of the order of some micrograms.

In the vicinity of its second end, or front end, the tube 10 contains a detection device 12 which is formed by conventional micro-channel wafer detectors and which is connected to a measuring device 13 outside the tube.

According to an essential feature of the invention, a simultaneous emission of electrons and of negative ions from the source 10 is provoked by subjecting the latter to the action of a constant electric field. To this end, a grid-shaped electrode 15 is placed in front of the foil 11*a*, parallel to this foil and spaced therefrom, and a difference in potential is established between the metal foil 11*a* and the grid 15. For example, the grid 15 is taken to the reference potential (earth) whilst a constant negative voltage V− furnished by a voltage generator 16 is applied to the foil 11*a* by means of a conductor passing through the wall of the tube 10.

The electrons and negative ions emitted under the action of the electric field are accelerated by the latter and "fly" up to the detection device 12, passing through the electrode 15 which is preferably formed by a very fine grid with a high transparency rate (for example 90%).

The electrons and ions are emitted simultaneously and received successively in the order of increasing mass. At each electron or ion received, the detection device 12 produces an electric signal sd which is applied to the measuring device 13. Since there is time correlation between emission of the electrons and emission of the ions, and since the time of flight of an electron is known, the reception of an electron by the detection device may be used as time reference for measuring the times of flight of the negative ions received thereafter.

The measuring device 13 comprises a constant fraction discriminator circuit 21, a time-to-digital converter 22 and a data acquisition circuit 23.

The circuit 21 converts each signal sd into a pulse calibrated to a level compatible with the circuits used downstream. Such a constant fraction discriminator circuit is known per se; the circuit marketed under reference 7174 by the French firm ENERTEC (SCHLUMBERGER) may in particular be used.

The output of circuit 21 is, on the one hand, connected directly to a start control input 22*d* of the time-to-digital converter 22 and, on the other hand, connected by a constant delay circuit 24 to an input 22*s* for controlling the stop of this same converter. For converter 22, the circuit whose principle is described by E. Festa and R. Sellem in the U.S. publication "Nuclear Instruments and Methods" No. 188 (1981) , page 99, may for example be used. After having received a starting signal, such a converter may accept, in a predetermined limited interval of time (for example 16 or 32 microseconds), a plurality of stop signals (for example 32) and furnishes, in response to each stop signal, a digital word representing the time lapsed between the reception of the starting signal and the reception of this stop signal. These digital words are registered via the data acquisition circuit 23 connected at the output of converter 22.

An operating cycle of the converter 22 is started, virtually in all cases, by a signal generated in response to the reception of an electron. The same signal, delayed by the circuit 24, furnishes a first result of counting, which makes possible, on the one hand, a display and counting of the electrons received and, on the other hand, makes it possible to have a precise reference for measuring the times of reception of the negative ions since the corresponding signals are also conducted towards the stop control input 22*s* through the delay circuit 24.

The results or counts obtained at the same relative instants of successive operating cycles of the converter 22, in the course of a period of observation, are accumulated to furnish the desired mass spectrum. By way of indication, the duration of a period of observation is a few minutes.

Figure 2A:
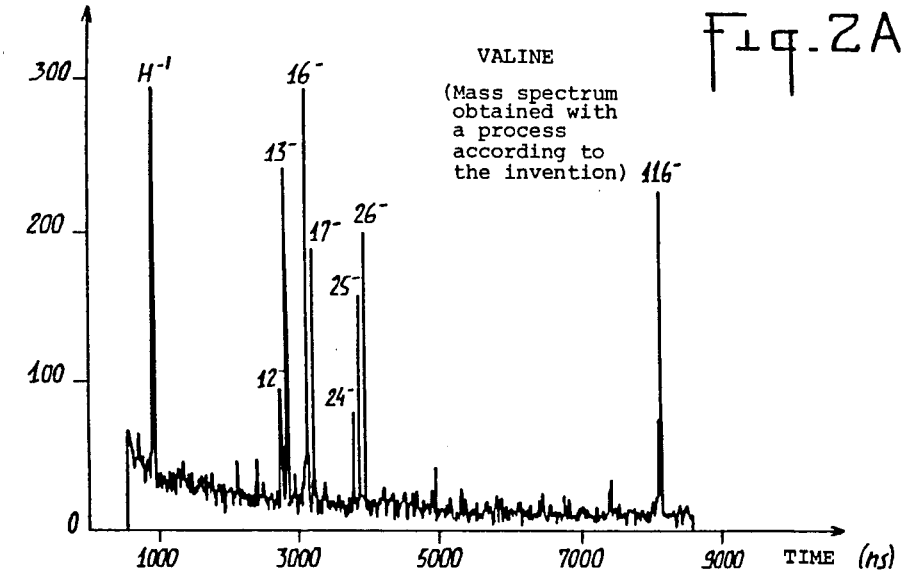
FIGS. 2A and 2B are spectra obtained for the same organic compound with the process according to the invention and with a process of the prior art, respectively.

FIG. 2A shows the mass spectrum of the valine organic compound (of molecular weight 117) obtained by means of a spectrometer such as that of FIG. 1, the tube 10 having a length of 0.3 m and a diameter of 0.1 m. A voltage of −9kV was applied to the foil 11*a*, the grid 15 being distant therefrom by 5 mm.

The first peak in FIG. 2A is produced by the reception of the electrons delayed by the circuit 24. This first peak furnishes an origin offset for measuring the times of flight, and its integral gives the total number of electrons $ne^-$ which have generated a start signal. A desorption yield for a negative ion of mass n may be defined as being the ratio between the number of counts in the peak of mass m and the number $ne^-$. For the valine−negative ion ($m=116^-$), the spontaneous desorption yield thus calculated is 1% in this example.

Figure 2B:
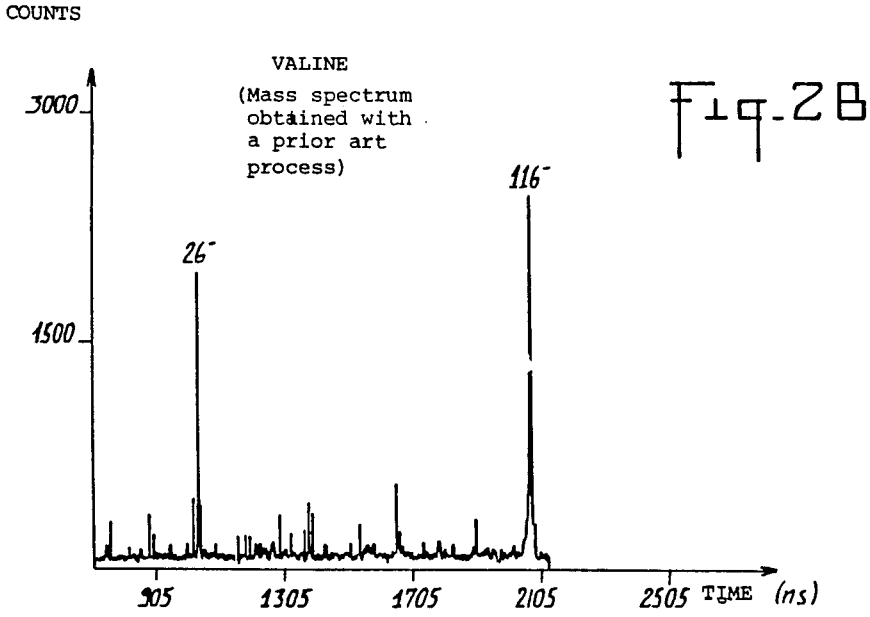

By way of comparison, FIG. 2B shows the mass spectrum of the same compound obtained by means of a spectrometer in which a conventional radioactive source of $^{252}Cf$ is used to release the ions. by desorption. It will be noted that the spectrum obtained with the spectrometer according to the invention differs from that of FIG. 2B by the presence of peaks more marked for the masses corresponding to $C^-$, $CH^-$, $O^-$ and $OH^-$.

Although an embodiment of the invention for obtaining a spectrum of an organic compound of relatively low molecular weight has been described hereinabove, it should be noted that molecular ions of masses ranging from 2000 to 3000 have been observed by this technique of spontaneous desorption.

Furthermore, the invention is, of course, not limited to the determination of mass spectra of organic compounds. Measurements may be made for example on metallic sources constituted directly by a foil of the metal or alloy to be examined taken to the desired potential.

The intensity of the electric field to be established to effect the spontaneous desorption of negative ions simultaneously with the emission of electrons is, to a certain extent, selected as a function of the nature of the molecular deposit 11*b* and the performances of the measuring device. In fact, the emission begins when the intensity of the electric field goes beyond a certain threshold. Furthermore, as the emission increases when the intensity of the field increases, the number of electrons may become such that the capacity of acquisition of the measuring device is saturated and part of the events is lost for values of intensity exceeding a certain threshold.

In the case of the embodiment of the invention described hereinbefore, with a space of 5 mm between the foil 11*a* and the electrode 15, it has been noted that the emission begins when the voltage applied to the foil 11*a* becomes, in absolute value, higher than 3 or 4kV. For a value of 10kV on 5 mm, the number of electrons counted in one second is less than 10000. At the value of 15kV on 5 mm, the number of electrons has become such that the capacity of acquisition of the measuring device used in this example is saturated.

A field value of between 1 and 3 MV/m generally appears to suit, the adaptation of this value being effected depending on the nature of the molecular deposit. It will be noted that this value remains much lower than the levels which are used for effecting a desorption by violent field effect in mass spectrometers of magnetic type. Moreover, in the case of the present invention, the moderate electric field is applied for the whole duration of the observation and the instant of its application does not constitute a time reference.

What is claimed is:

1. A process for determining mass spectrum by time of flight measurement, said process including the steps of:

providing a source having a plane solid surface containing a product to be analyzed in mass, continuously subjecting said source to the action of a constant electric field in vacuum to produce the simultaneous and repetitive emission, on the one hand, of electrons and, on the other hand, of negative ions from said surface by spontaneous desorption, detecting said emitted electrons and negative ions by a common detector, and determining the mass spectrum from the measured differences in time of flight of the electrons and of the negative ions between the source and the detector.

2. A process as claimed in claim 1, wherein said electric field is produced by establishing a difference of potential between said solid surfaces of said source and a grid-shaped electrode disposed parallel thereto.

3. A process as claimed in claim 1, wherein the intensity of said electric field is between 1 and 3 MV/m.

4. A time of flight mass spectrometer comprising:

an enclosure adapted to be connected to a vacuum source, means for generating a constant electric field in said enclosure, and continuously applying said electric field to a source having a solid plane surface containing a product to be analyzed in mass so as to cause the simultaneous and repetitive emission, on the one hand, of electrons and, on the other hand, of negative ions from said surface by spontaneous desorption, a detector arranged in said enclosure to receive both said emitted electrons and said negative ions, said detector generating a signal in response to the reception of each electron and negative ion, and measuring means connected to said detector for receiving the signals generatd thereby, and for determining the mass spectrum sought by measuring the intervals of time between the reception of electrons and subsequent reception of negative ions by the detector.

5. A time of flight spectrometer according to claim 4, wherein said means for generating a constant electric field includes a grid-shaped electrode placed in front of said solid plane surface, and means for establishing a potential difference between said electrode and said solid plane surface.

6. A time of flight spectrometer according to claim 5 wherein said grid-shaped electrode is disposed parallel to said solid plane surface.

* * * * *